US007714551B2

(12) United States Patent
Fan et al.

(10) Patent No.: US 7,714,551 B2
(45) Date of Patent: May 11, 2010

(54) HIGH PSRR LINEAR VOLTAGE REGULATOR AND CONTROL METHOD THEREOF

(75) Inventors: Cheng-Hsuan Fan, Hsinchu (TW); Chao-Hsuan Chuang, Jhubei (TW); Hung-Che Chou, Jiadung Township, Pingtung County (TW); Ching-Hsiang Yang, Tauyuan (TW); Chih-Ping Tan, Chiunglin Township, Hsinchu County (TW)

(73) Assignee: Richtek Technology Corp., Hsinchu (TW)

( * ) Notice: Subject to any disclaimer, the term of this patent is extended or adjusted under 35 U.S.C. 154(b) by 401 days.

(21) Appl. No.: 11/705,090

(22) Filed: Feb. 12, 2007

(65) Prior Publication Data

US 2007/0188154 A1 Aug. 16, 2007

(30) Foreign Application Priority Data

Feb. 14, 2006 (TW) ..... 95104969 A

(51) Int. Cl.
*G05F 1/40* (2006.01)

(52) U.S. Cl. ..... 323/273

(58) Field of Classification Search ..... 323/273–277, 323/282–285

See application file for complete search history.

(56) References Cited

U.S. PATENT DOCUMENTS

| | | | | |
|---|---|---|---|---|
| 5,414,341 | A * | 5/1995 | Brown | 323/268 |
| 7,098,639 | B2 * | 8/2006 | Natsume et al. | 323/282 |
| 2005/0046405 | A1 * | 3/2005 | Trafton et al. | 323/308 |

* cited by examiner

*Primary Examiner*—Adolf Berhane
(74) *Attorney, Agent, or Firm*—Rosenberg, Klein & Lee

(57) ABSTRACT

A linear voltage regulator comprises a transistor for converting a supply voltage to an output voltage. By directly monitoring the supply voltage and thereby rapidly responding when the supply voltage suffers a ripple, the linear voltage regulator enhances the stability of the output voltage.

8 Claims, 3 Drawing Sheets

HIGH PSRR LINEAR VOLTAGE REGULATOR AND CONTROL METHOD THEREOF

FIELD OF THE INVENTION

The present invention is related generally to power supplies and, more particularly, to a high PSRR linear voltage regulator.

BACKGROUND OF THE INVENTION

To convert a supply voltage Vin to an output voltage Vout, as shown in FIG. 1, a typical linear voltage regulator 10 comprises a transistor 16 coupled between the power input node Vin and the power output node Vout, and being controlled to regulate the output voltage Vout. In addition, a bypass capacitor C is coupled between the output Vref of a reference voltage generator 12 and ground GND to stabilize the reference voltage Vref, voltage divider resistors R1 and R2 coupled between the power output node Vout and ground GND divides the output voltage Vout to produce a feedback signal VFB, and an error amplifier 14 compares the feedback signal VFB with the reference voltage Vref to determine an error signal $V_{EA}$ which is coupled to the gate of the transistor 16 to adjust the channel width of the transistor 16. In this circuit configuration, the Power Supply Reject Ratio (PSRR) of the output voltage Vout is contributed from the PSRR of the reference voltage Vref and the PSRR of the error signal $V_{EA}$. Particularly, in high frequency applications, ranged from several tens of KHz to hundreds of KHz, such as wireless communications, the output voltage Vout is required to be highly stable. Ideally, both the reference voltage Vref and the supply voltage Vin are constant, however, it is not the case actually. Ripple may occur on the reference voltage Vref, and thereby results in perturbation on the output voltage Vout. For this reason, it is a simple and common resolution to use the bypass capacitor C to reduce the ripple on the reference voltage Vref, to thereby improve the PSRR of the output voltage Vout. Not only the reference voltage Vref, the supply voltage Vin may also have a ripple, which would also cause a perturbation on the output voltage Vout. When the supply voltage Vin suffers a ripple, it causes the output voltage Vout varying, and this information will be reflected on the feedback voltage VFB. Through the error amplifier 14 feedback loop, the channel width of the transistor 16 will be adjusted to stable the output voltage Vout. When the bypass capacitor C is maximized, the total loop PSRR is still limited by the error amplifier 14 and transistor 16 feedback loop response. In addition, sensing the output response to improve the PSRR always lags since the output voltage Vout has already dropped or raised. Therefore, the linear voltage regulator 10 cannot respond rapidly to the input transient when the supply voltage Vin suffers a ripple. To solve this problem, conventionally, circuit designers focus on improving the response time of the error amplifier 14 or the feedback loop. However, no matter how fast the response time of the error amplifier 14 or the feedback loop is improved, it is still established through the feedback loop based on the output voltage Vout, and the linear voltage regulator 10 always responds after the output voltage Vout suffers the perturbation resulted from the ripple on the supply voltage Vin. More severely, altering the response time of the error amplifier 14 or the feedback loop may also change the original stability range and compensation of the linear voltage regulator 10.

Therefore, it is desired a linear voltage regulator which can eliminate the influence of the supply voltage ripple before it causes a perturbation on the output voltage.

SUMMARY OF THE INVENTION

An object of the present invention is to provide a high PSRR linear voltage regulator and a control method thereof.

Particularly, another object of the present invention is to eliminate the influence of the supply voltage ripple before it causes a perturbation on the output voltage of a linear voltage regulator.

Yet another object of the present invention is to provide a linear voltage regulator and a method thereof, which can reduce the influence of the supply voltage ripple without changing the original stability range and compensation of the linear voltage regulator.

According to the present invention, a linear voltage regulator comprises a transistor for converting a supply voltage to an output voltage, a first monitoring circuit for monitoring the output voltage in order to determine an output-dependent signal to control the transistor, so as to regulate the output voltage, and a second monitoring circuit for monitoring the supply voltage in order to determine an input-dependent signal to control the transistor, so as to prevent the output voltage from a perturbation due to a supply voltage ripple.

By directly monitoring the supply voltage and reflecting the ripple on the supply voltage to the input-dependent signal to control the transistor, the linear voltage regulator can rapidly respond to the input transient before the output voltage suffers a perturbation, without changing the original stability range and compensation of the linear voltage regulator.

BRIEF DESCRIPTION OF DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
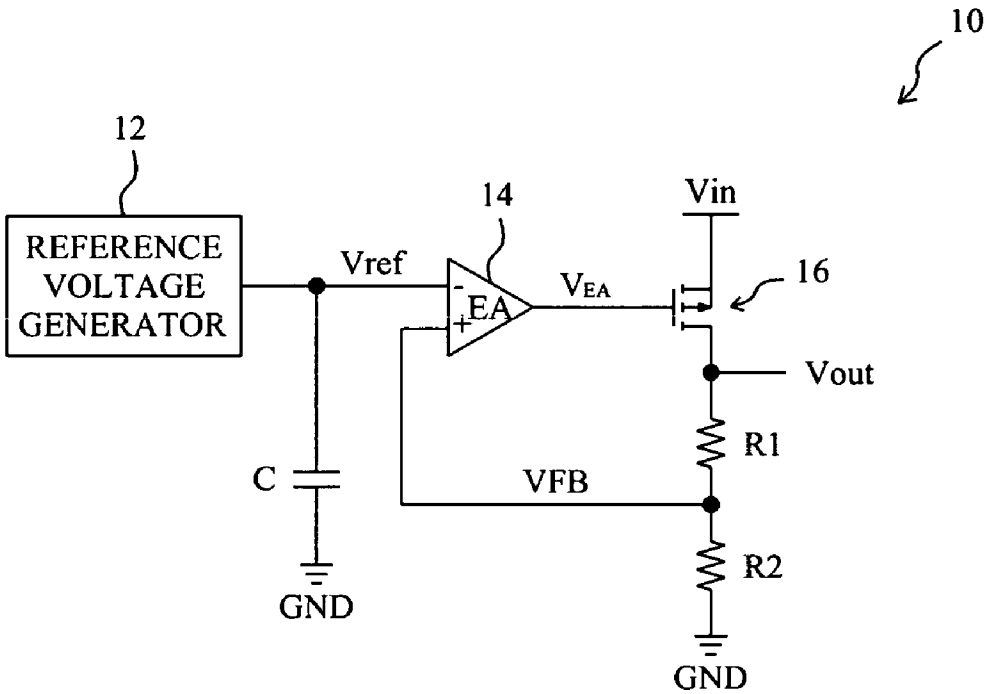
FIG. 1 PRIOR ART
FIG. 1 shows a conventional linear voltage regulator.
Figure 2:
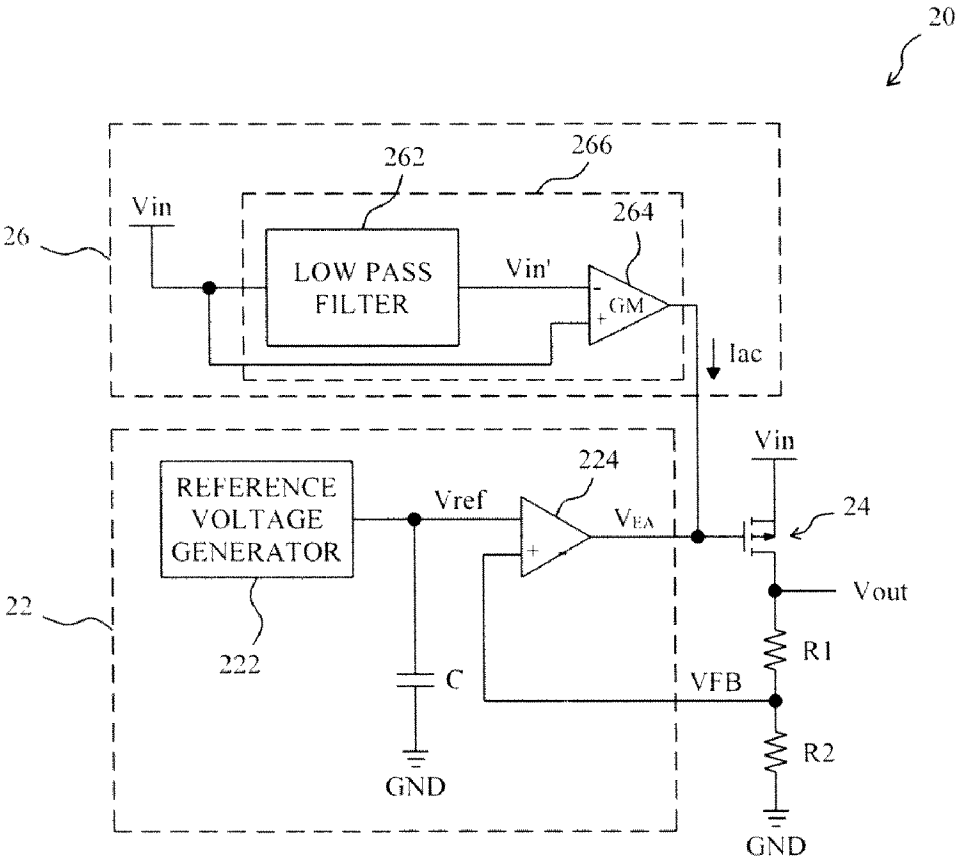
FIG. 2 shows an embodiment according to the present invention.

FIG. 2 shows an embodiment according to the present invention. In a linear voltage regulator 20, a transistor 24, for example a PMOS, has an input terminal for receiving a supply voltage Vin, an output terminal for providing an output voltage Vout, and a gate for receiving control signals to adjust the channel width of the transistor 24. To control the transistor 24, a monitoring circuit 22 monitors the output voltage Vout and thereby provides an output-dependent signal $V_{EA}$ coupled to the gate of the transistor 24, and a monitoring circuit 26 monitors the supply voltage Vin and thereby provides an input-dependent signal Iac coupled to the gate of the transistor 24. Voltage divider resistors R1 and R2 are coupled between the output node Vout and ground GND to divide the output voltage Vout in order to produce a feedback voltage VFB. In the monitoring circuit 22, a reference voltage generator 222 provides a reference voltage Vref, a bypass capacitor C is coupled between the output Vref of the reference voltage generator 222 and ground GND to filter out the ripple on the reference voltage Vref, and an error amplifier 224 compares the feedback voltage VFB with the reference voltage Vref to determine the output-dependent signal $V_{EA}$. By using the output-dependent signal $V_{EA}$, the monitoring circuit 22 adjusts the channel width of the transistor 24 according to the feedback voltage VFB, so as to control the current flowing through the transistor 24 and thereby to regulate the output voltage Vout at a target. In the monitoring circuit 26, a low-pass filter 262 produces a delta voltage Vin' from the supply voltage Vin, and a transimpedance amplifier 264 determines the input-dependent signal Iac according to the supply voltage Vin and the filtered version, the delta voltage Vin'. In one embodiment, the input-dependent signal Iac is proportional to the ripple on the supply voltage Vin. By introducing the input-dependent signal Iac to the gate of the transistor 24, the monitoring circuit 26 thus prevents the output voltage Vout from the perturbation due to the ripple on the supply voltage Vin.

In other embodiments, the monitoring circuit 26 can be modified, for example being configured with a high-pass filter 266. Generally, the monitoring circuit 26 may comprise any circuits such that the input-dependent signal Iac will reflect the situation of the supply voltage Vin.

Figure 3:
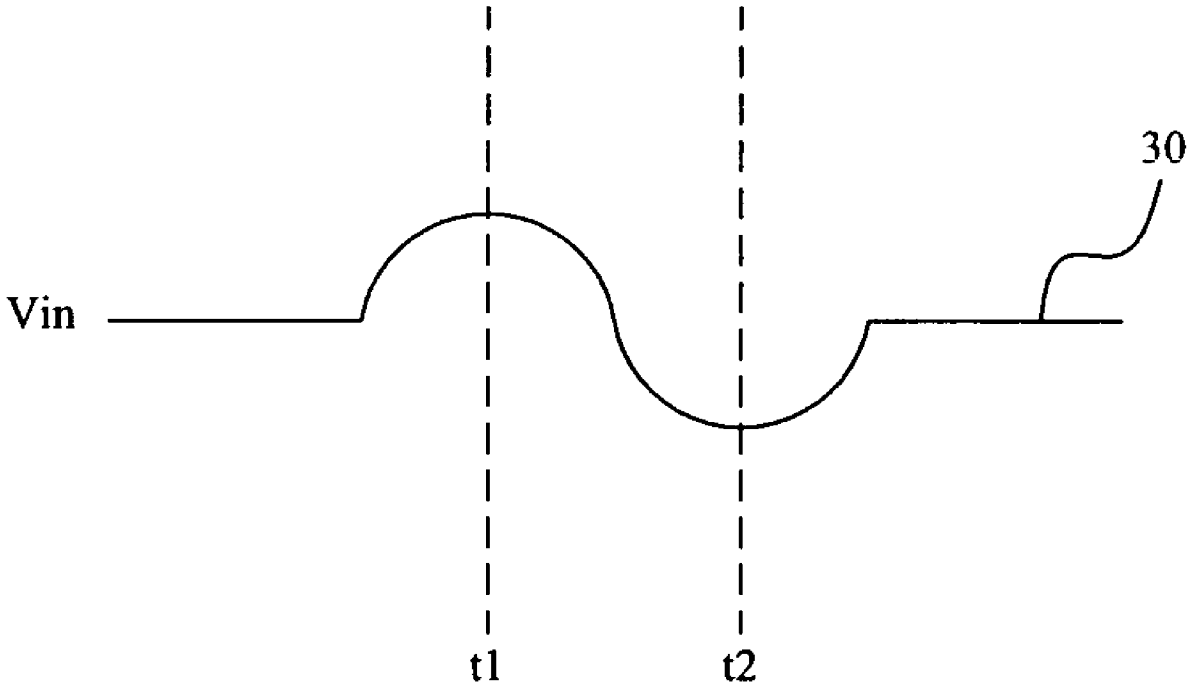
FIG. 3 shows a waveform of a supply voltage Vin having a ripple thereon.

FIG. 3 shows a waveform 30 of the supply voltage Vin when it suffers a ripple. Nearby time t1, the supply voltage Vin increases, which causes the input-dependent signal Iac to increase accordingly, and thereby pull the gate bias up. Therefore, the channel of the transistor 24 becomes narrower, and the rising ripple on the output voltage Vout is reduced. Contrarily, nearby time t2, the supply voltage Vin decreases, which causes the input-dependent signal Iac to decrease accordingly, and thereby pull the gate bias down. Therefore, the channel of the transistor 24 becomes wider, and the falling ripple on the output voltage Vout is reduced.

By directly monitoring the supply voltage Vin to adjust the channel width of the transistor 24 in response to the supply voltage ripple, the linear voltage regulator 20 does not alter the error amplifier 224 feedback loop, and therefore will not change the original stability range and compensation of the linear voltage regulator 20. As a result, the linear voltage regulator 20 could rapidly respond to the input transient when the supply voltage Vin suffers a ripple, before it causes a perturbation on the output voltage Vout.

As it is shown by the above embodiment, direct sensing the input transient and forward in a linear voltage regulator improve the high frequency PSRR of the output voltage without pushing the bandwidth of the voltage loop, and without sensing the output voltage to improve the PSRR of the linear voltage regulator, it will change the original stability range and compensation of the linear voltage regulator.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A linear voltage regulator for converting a supply voltage to an output voltage, the linear voltage regulator comprising:

a transistor having an input terminal for receiving the supply voltage, an output terminal for providing the output voltage, and a control terminal for adjusting a channel width of the transistor;

a first monitoring circuit monitoring the output voltage and determining an output-dependent signal, said output-dependent signal being coupled to the control terminal to regulate the output voltage; and a second monitoring circuit coupled to an output of said first monitoring circuit and monitoring the supply voltage, said second monitoring circuit producing an input-dependent signal reflecting a ripple occurring in said supply voltage, said input-dependent signal being coupled to the control terminal of said transistor to adjust the channel width of said transistor in accordance with ripple occurring in said supply voltage, thereby preventing the output voltage from perturbation due to said supply voltage ripple.

2. The linear voltage regulator of claim 1, wherein the first monitoring circuit comprises an error amplifier for comparing an output-dependent voltage with a reference voltage to determine the output-dependent signal.

3. The linear voltage regulator of claim 1, wherein the second monitoring circuit comprises:

a filter for filtering the supply voltage to produce a delta voltage; and a transimpedance amplifier for determining the input-dependent signal according to the supply voltage and the delta voltage.

4. The linear voltage regulator of claim 3, wherein the filter comprises a low-pass filter.

5. The linear voltage regulator of claim 1, wherein the second monitoring circuit comprises a high-pass filter.

6. A control method for a linear voltage regulator to convert a supply voltage to an output voltage, the control method comprising the steps of:

determining an output-dependent signal by monitoring the output voltage for regulating the output voltage; and determining an input-dependent signal by monitoring the supply voltage, wherein said input-dependent signal reflects a ripple occurring in said supply voltage, and controlling said output voltage with said input-dependent signal, thereby preventing the output voltage from a perturbation due to said supply voltage ripple.

7. The control method of claim 6, wherein the step of determining an output-dependent signal by monitoring the output voltage comprises the step of comparing an output-dependent voltage with a reference voltage for determining the output-dependent signal.

8. The control method of claim 6, wherein the step of determining said input-dependent signal by monitoring the supply voltage comprises the steps of:

determining a delta voltage by filtering the input voltage; and determining the input-dependent signal according to the supply voltage and the delta voltage.

* * * * *